United States Patent [19]

Murphy

[11] Patent Number: 4,761,866

[45] Date of Patent: Aug. 9, 1988

[54] METHOD OF WORKING IN SITU THE END OF A HEAT EXCHANGER TUBE

[75] Inventor: Mark A. Murphy, South Bend, Ind.

[73] Assignee: Sundstrand Corporation, Rockford, Ill.

[21] Appl. No.: 934,213

[22] Filed: Nov. 25, 1986

[51] Int. Cl.[4] ..... B21D 53/02

[52] U.S. Cl. ..... 29/157.3 C; 29/406; 29/523; 29/727

[58] Field of Search ..... 29/157.3 C, 157.3 R, 29/727, 505, 523, 33 D, 33 G, 33 T, 157.4, 406, 407, 445, 464, 282, 293.5; 72/370; 228/154

[56] References Cited

U.S. PATENT DOCUMENTS

| | | | |
|---|---|---|---|
| 2,675,050 | 4/1954 | Downing | 72/342 X |
| 2,736,361 | 2/1956 | Kocks | 72/342 X |
| 3,739,620 | 6/1973 | Jesmore et al. | 72/370 |
| 3,826,122 | 7/1974 | Brauninger | 72/370 |
| 4,164,807 | 8/1979 | King, Sr. | 29/523 |
| 4,327,567 | 5/1982 | Martin . | |
| 4,584,765 | 4/1986 | Gray . | |
| 4,585,751 | 4/1986 | Gray . | |
| 4,653,305 | 3/1987 | Kanamaru et al. | 72/370 |

FOREIGN PATENT DOCUMENTS

| | | | |
|---|---|---|---|
| 743526 | 1/1956 | United Kingdom | 29/479 |

*Primary Examiner*—Howard N. Goldberg
*Assistant Examiner*—Irene Cuda
*Attorney, Agent, or Firm*—James A. Wanner; Trevor B. Joike; Harold A. Williamson

[57] ABSTRACT

This invention is directed to a method of working the free end of heat exchanger tubes, and particularly the formation of braze cups, with the heat exchanger tubes in situ relative to the heat exchanger core with the method including the step of utilizing centering tooling positioned about a tube expansion rod to assure that the braze cup is centered relative to its respective tube axis.

10 Claims, 2 Drawing Sheets

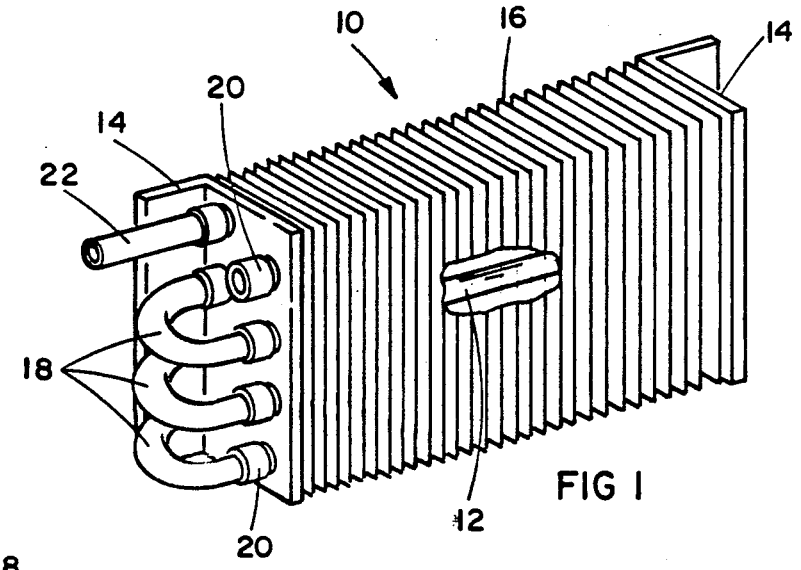
FIG 1
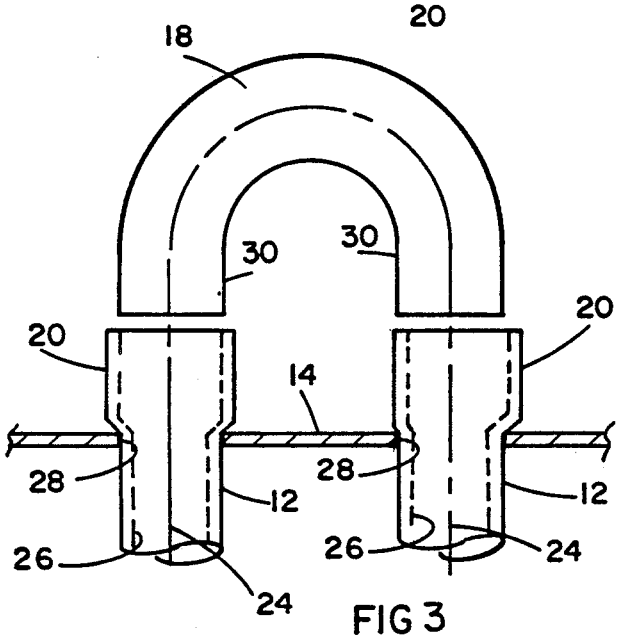
FIG 3
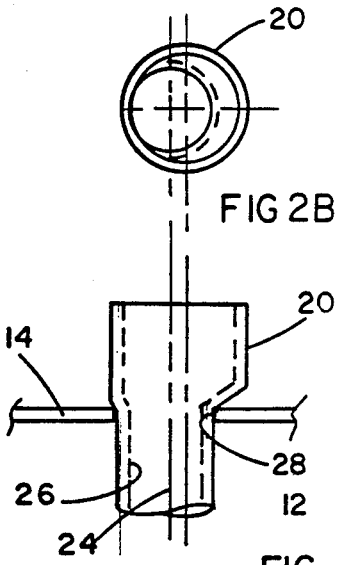
FIG 2B
FIG 2A
PRIOR ART
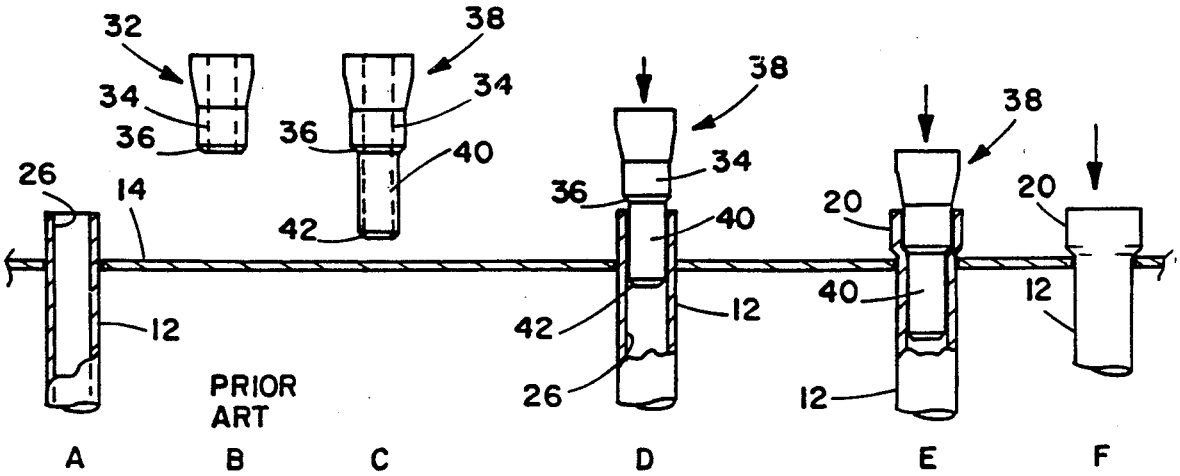
FIG 4

METHOD OF WORKING IN SITU THE END OF A HEAT EXCHANGER TUBE

FIELD OF THE INVENTION

This invention relates to working in situ the free ends of heat exchange tubes, such as expanding or upsetting the tube free end to form a braze cup, utilizing improved methods and tooling to assure that the worked tube end portion is centered relative to the tube axis.

BACKGROUND OF THE INVENTION

In the construction of the heat exchanger, it is common to work the free end of the tubes, sometimes referred to as the tube studs. Such working may be upsetting the nominal tube inner diameter (ID) to a larger ID to provide a braze cup, for axially receiving a further conduit. Since other elements of the heat exchanger core, such as fin plates and end plates, must be positioned over the heat exchanger tubes in close physical contact therewith prior to the upsetting operation, the formation of the braze cups must take place in situ.

The prior art contains many disclosures which comprise the steps of preparing a heat exchanger core for upsetting by providing a fin plate having a plurality of tube receiving openings with a tube end portion extending through each opening, and then upsetting the tube end portions to form braze cups. Such disclosures include, for example, U.S. Patent No. 4,272,576 issued June 9, 1981 to [illegible] and U.S. Patent No. 4,376,[illegible] issued March 15, 1983 to [illegible]. In the first patent, the tube end portions are upset to form braze cups which are axially aligned with the tube axis, and in the second patent, the tube end portions are upset to form braze cups which are radially aligned with the tube axis. In the second centering means is of sufficient length so as to be responsive to tube position as so established.

It is also an object of the present invention to provide a method of working in situ the end of a hollow heat exchanger tube positioned within a heat exchanger core, the method comprising the steps of positioning the hollow tube through an opening in a core end plate with a free end of the tube extending beyond the end plate, axially moving a tube end working tool having an axial extension toward the tube end, centering the working tool relative to the tube axis by physical cooperation between the tool extension and the tube bore upon axial movement of the tool, and working the tube free end with the tool so centered relative to the tube axis.

Still another object of the present invention is a method of working in situ the ends of at least a pair of spaced apart hollow heat exchanger tubes positioned within a heat exchanger core, said method comprising the steps of positioning the pair of hollow tubes through a pair of end plate openings forming a part of the heat exchanger core with a free end of each of said tubes extending beyond the end plate, forcing a pair of expansion rods through the bores of the pair of tubes to radially expand the tubes into frictional abutment with said plate openings, axially moving a pair of working tools having axial extensions positioned about the pair of rods toward said free ends of said tubes, centering the working tools relative to the tube axes by physical cooperation of the tool extension with the tube bores upon axial movement of the tools, and working the tube free ends with the tools so centered relative to the tube axes.

Description of the Drawings

FIG. 1 is an isometric view of a heat exchanger core manufactured utilizing the methods of the present invention.

FIG. 2A is a side view of a misaligned braze cup as frequently encountered with prior art methods and tooling.

FIG. 2B is an end view of the misaligned braze cup of FIG. 2A.

FIG. 3 is a side view of a pair of tubes with braze cups designed to receive a return bend with the left braze cup properly aligned and the right braze cup misaligned.

FIG. 4 is a side view, partly in section, showing a plurality of steps and tools for end working a heat exchanger tube.

BRIEF DESCRIPTION OF THE PREFERRED EMBODIMENT

Figure 5:
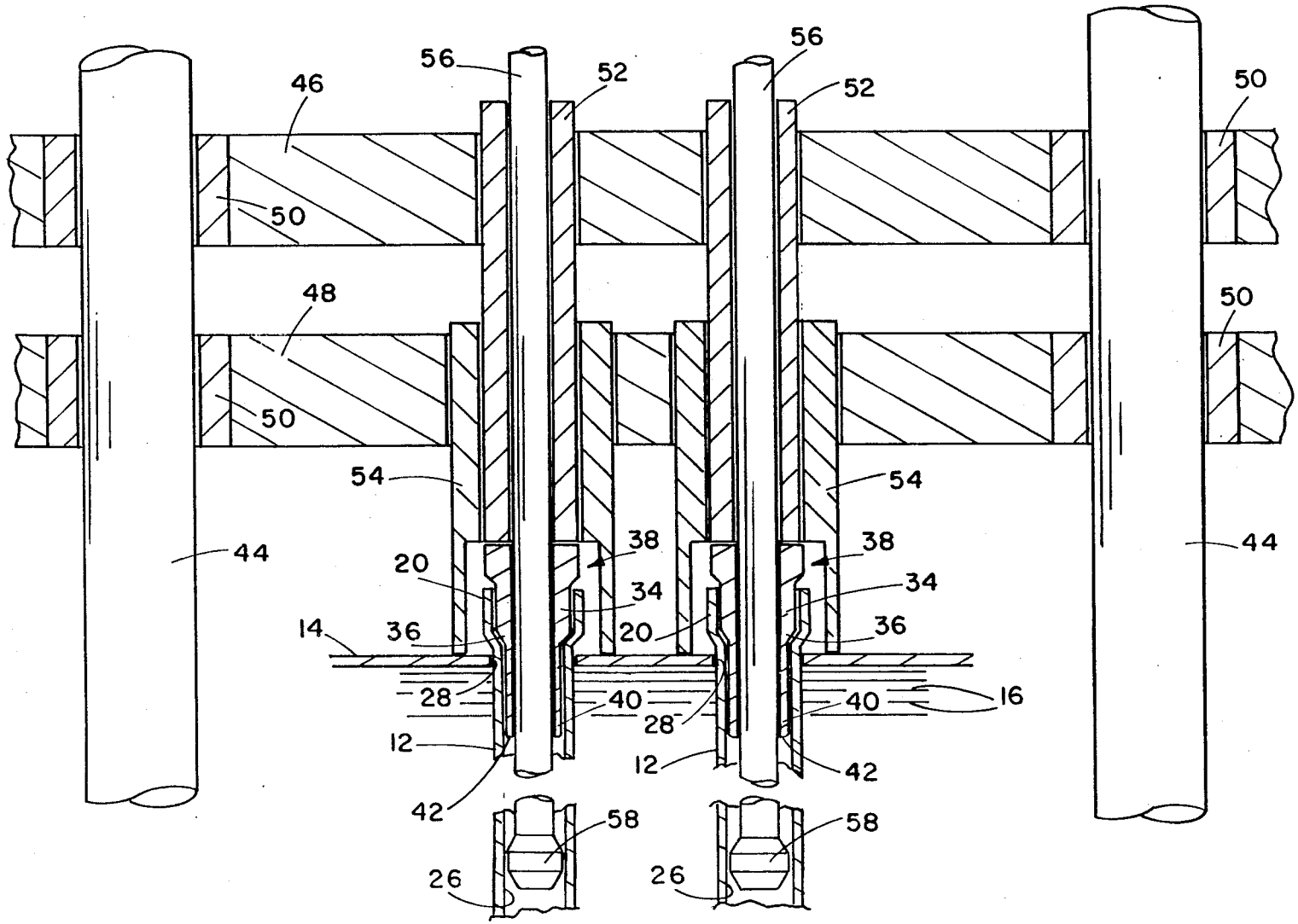
FIG. 5 is a side view, partly in section, of a tooling assembly having a pair of the improved upsetting tools of the present invention.

FIG. 1 is a pictorial view of one form of heat exchanger core which can be manufactured utilizing the improved methods and tooling of the present invention. Heat exchanger core 10 has several heat exchanger tubes 12 extending axially therethrough. At each end of the core 10 is an end bracket or end plate 14. Located between the end plates 14 are many parallel plate fins 16 positioned transversely to the heat exchanger core. At least one end of the core 10 has several return bends 18 each joining pairs of the heat exchanger tubes 12 with the return bends 18 being positioned within worked (upset) end portions at the free ends of the tubes 12 forming braze cups 20. Other tube braze cups 20 can receive conduits such as 22 for the ingress and egress of heat exchanger fluid.

As described in detail below, the heat exchanger tubes 12, after being inserted in the core stack 10 consisting of the end plates 14 and the plates fins 16, may be radially expanded to provide tight frictional contact with openings in the fins and end plates 14 to both physically position the tubes 12 and also assure good thermal conductivity between the tubes 12 and the plate fins 16. The tubes 12 may be straight sections joined by return bends 18 at each end or the heat exchanger tubes 12 can be of elongated hair pin shapes inserted from one end of the heat exchanger stack and joined by return bends 18 only at the other end thereof. However, with either construction, since it is desirable to have the fins and end plates openings in close physical contact to the OD of tubes 12, the braze cups 20 which are of larger OD than the tube 12 nominal OD must be formed after the tubes 12 are in place within the heat exchanger core 10. Thus, the braze cups 20 are formed in situ.

Previous manufacturing processes in forming the braze cup 20 has often resulted in misalignment such as shown in FIGS. 2A and 2B representing prior art. As can be in this prior art example, the braze cup 20 is not aligned or centered relative to the central axis 24 or the bore 26 of the tube 12. In fact it is not uncommon for the bell axis 28 to be askew or off-center by as much as 0.010 inch and such misalignment can occur in random directions relative to the tube axis 24. Such misalignment has occurred even though the tube end upseting tool forming the braze cup is positioned about a tube expander rod discussed in detail below.

Such misalignment creates manufacturing difficulties when trying to insert a return bend 18 into a pair of braze cups 20. This is represented in FIG. 3 wherein the left braze cup 20 is aligned with the tube axis 24 and the right braze cup 20 is misaligned relative to its respective tube axis 24. The pair of tubes 12 are relatively accurately positioned by a pair of openings 28 in the end plate 14, such openings 28 being formed by a stamping operation when the end plate 14 is maufactured. The return bend 18 is bight-shaped having a pair of ends 30 designed to be received by the braze cups 20. However, the return bend 18 is also premanufactured with the distance between the ends 30 being substantially equal to the distance between the plate openings 28. Again, the manufacturing process for the return bend 18 is also relatively accurate. Thus, the ends 30 of the return bend 18 should easily be received by the braze cups 20. However, the misalignment of either of the braze cups 20 prevents, or at least hinders, the successful mating of the respective parts. This is, of course, magnified if the pair of braze cups 20 are both misaligned, but in opposite directions. Even if the misalignment is not to the extreme which prevents mating of the parts, the misalignment will cause an uneven radial gap between the end 30 of the return bend 18 and its respective braze cup 20. Such uneven radial gap prevents obtaining a uniform brazed joint.

FIG. 4 discloses various steps in forming heat exchanger tube braze cups. FIG. 4A depicts the heat exchanger tube 20 already positioned relative to the end plate 14 of the heat exchanger core. The free end of the tube, or the tube stub, extends beyond the end plate 14. At this point, the tube 20 has already been radially expanded to be frictionally secured within an opening, such as opening 28 of FIG. 3, in the end plate 14. However, the braze cup is yet to be formed by cold working or upsetting.

FIG. 4B depicts a prior art working tool, which in this case is in upsetting tool 32 having an expansion or extruder section 34 and a tapered lead-in section 36. This tool 32 is referred to as the standard extruder trip.

The improved working tool utilized in practicing the method of the present invention is the upsetting tool 38 of FIG. 4C referred to as the improved extruder tip. The tool 38 again has both the expansion or extruder section 34 and tapered section 36 of the prior art tool 32. However, the improved tool also has an axial extension 40 with a lead-in taper 42 as shown in FIG. 4C. With the improved tool 38, the tapered section 36 now acts as a transition taper between the centering extension 40 and the extruder section 34.

FIGS. 4D, E, and F depict the in situ forming of the braze cup 20 of the tube 12. The improved tool 38 is moved axially so that the centering extension 40 enters the tube 12 so as to radially position the tool 38 relative to the tube's axis. Preferably, the centering extension 40 is of sufficient length so as to axially extend within the free end of the tube 12 a sufficient distance so that the lead-in taper 42 passes the axial position of the end plate 14. Ideally, the centering extension 40 has an OD just slightly smaller, such as by 0.001 inch but no more than 0.004 inch, than the ID of the tube bore 26. It is noted that the axial tool position shown in FIG. 4D accurately centers the tool 38 relative to the tube axis with a radial physical cooperation between the extension 40, the wall of tube 12, and the end plate opening 28 (all in the plane of the end plate 14) prior to the transition taper 36 engaging the outer end of the tube 12. FIG. 4E shows further axial movement of the upsetting tool 38 with the tapered transition portion 36 and extruder section 34 generating the braze cup 40 by cold working or upsetting of the free end of the tube 12. FIG. 4F shows the resulting braze cup 20 and the tube 12 with the braze cup centered relative to the tube axis due to the physical cooperation of the guiding extension 40.

FIG. 5 teaches a manufacturing tooling assembly for performing the operations of the methods of the present invention. The tooling assembly, except the present invention. The tooling assembly, except the extensions 40 on the extruder tips 38, is similar to prior art heat exchanger manufacturing tooling. The tooling assembly has a pair of guide posts 44 locating a body plate 46 and a stripper plate 48. The plates 46 and 48 are mounted on the guide post 44 by means of bushings 50 which typically have a clearance of 0.010 inch. Located on the body plate are a pair of extruder bodies 52 which have a clearance of 0.005 inch relative to the body plate 46. Located on the lower stripper plate 48 are a pair of stripper bodies 54 also having a clearance of 0.005 inch relative to the stripper plate 48. One improved extruder tip 38 with its axial extension 40 is located at the lower end of each extruder body 52 and within cavities at the lower end of strippers 54. It is noted that each extruder body 52 and extruder tip 38 are provided with central bores through which pass expander rods 56, each having at the lower end thereof an expander ball or bullet 58. The expander rods 56, the extruder bodies 52 with extruder tips 38, and the strippers 54 are all independently vertically reciprocable.

In manufacturing the heat exchanger, the heat exchanger stack forming the core 10 is positioned with the end plate 14 abutting the lower end of the strippers 54 and with the tubes 20 positioned within the plate openings 28. At this point, the extruder tips 38 are vertically positioned above the free end of the tubes 12 and not in contact therewith. The expander rods 56 are forced downwardly so that the bullet 58 cold works the tubes 12 by radially expansion to bring the tube OD into tight frictional engagement with both the end plate openings 28 and openings in the plate fins 16. This assures accurate positioning of the tubes 12 and also increases thermal conductivity between the tubes 12 and the plate fins. In a typical operation, using a 0.375 inch OD copper tube as an example, the bullet diameter is 0.359 inch and the expander rod diameter is 0.321 inch. Because of the length of the tubes 12 and thus the length of the tube expansion operation, the expander rod 56 must be of smaller diameter than the bullet 58 to prevent excessive friction between the rod 56 and the tube bore 26. However, this diameter differential presents a 0.019 inch radial gap between the expander rod 56 and the tube bore 26 even when the rod 56 is centered relative to the tube axis. Due to the clearances of the bushings 50, the expander body 52 to the body plate 46, a 0.004 inch clearance between the expander rod 56 and the extruder body 52, and normal flexure of the rod 56, there is sufficient play to permit the rod 56 and bullet 58 to line up with the tubes 12. However, it is these clearances rod flexure, plus the 0.019 inch radial gap mentioned above that prevent that any follow-up operation that will be centered relative to the axis of tube 12.

As the tube expansion operation is being completed, with the bullets 58 approaching end of travel, the extruder bodies 52 are driven downwardly by body plate 46 so that the lead-in taper 42, followed by the axial extension 40, of each extruder tip 38 enters the tubes 12. The axial extensions 40 have a diameter of 0.358 inch and just fit inside the tube 20 ID of 0.359 inch as generated by the expander bullet 58. This 0.001 inch total clearance, or 0.0005 inch radial clearance, between the extension 40 and the tube bore 26 assures that each extruder tip 38 is properly centered or aligned relative to the axis of its respective tube 12. Thus, the extension 40 due to it's physical cooperation with the wall of tube 20 provides the guiding or centering function. As noted in eariler reference to FIG. 4D, the extension 40 is of sufficient length so that it extends axially beyond the plane of plate 14 prior to engagement of the transition taper 36 with the free end of the tube 12. Thus, the tube 12 is positioned by the plate opening 28 and the working tip 38 is centered by the extension 40. Since the return bends 18 are toleranced relative to the spacing of plate openings 28, the positioning of the extruder tips 38 through the extensions 40 guarantees further operations that are also similarly spaced.

Further downward axial movement of the extruder body 52 and thus the extruder tips 38 causes the taper transition section 36 and then the extruder section 34 of the tool to enter the free end of the tube 12, that is the tube stub, to cause further expansion forming the braze cup 20. For the $\frac{3}{8}''$ tube example given, the extruder tool section 34 has a diameter of 0.380 inch, which provides a bell portion 20 having a 0.380 inch ID. This is 0.005 inch larger than the 0.375 inch OD of the return bend, which has the same OD as the nomimal OD (preworked diameter) of the tube 12. Since the above operations assure that the braze cups 20 are properly positioned, the 0.005 inch total gap between the return bend OD and the bell 20 ID provides a 0.0025 inch radial gap which is substantially uniform. This permits an even brazing operation to be obtained.

After the above mentioned operations are completed, both the extruder tools 38 and the expander rods 56 are vertically withdrawn from the tubes 12. The abutment between the end plate 14 and the strippers 54 facilitate such withdrawal. At this time, the strippers are held down against the end plate 14 to aid in withdrawal the finished heat exchanger core from the tooling assembly.

Since a 0.019 inch radial clearance exists between the expander rod 56 and the tube bore 26, without centering means being utilized, a gross misalignment of the braze cup 20 relative to the tube axis 24 would occur such as shown in the prior art FIGS. 2A and 2B. However, the methods of the present invention eliminate such misalignment problems. The principles described above relative to the ⅜ inch tube 20 apply equally as well to other size heat exchanger tubes. While FIG. 5 depicts only a pair of tubes 1 and a pair of expander/extruder assemblies, it is of course recognized that in normal manufacturing, there are many such assemblies for expansion of the tubes 12 and forming the braze cup. As an example, in order to manufacture the heat exchanger core of FIG. 1, eight such assemblies in two rows would be utilized in the manufacturing tooling.

It is noted that by utilizing the axial extension on the extruder tips, a substantially centered relationship of the braze cup relative to the heat exchanger tube is assured. This eliminates many of the problems encountered in the prior art assembly methods and thus the objects of the present invention are met.

I claim:

1. A method of working in situ the end of at least one hollow heat exchanger tube positioned within a heat exchanger core, said tube having a bore and central axis, said method comprising the steps of:

(a) positioning said hollow tube through an opening in a plate forming a part of said core with a free end of said tube extending beyond said plate;

(b) expanding said tube by forcing an expansion rod having an enlarged head through said tube to radially expand said tube into frictional abutment with said plate opening;

(c) axially moving a working tool positioned about said rod toward the free end of said tube;

(d) centering said working tool relative to said tube axis by means of an axial tool extension cooperating with said tube bore as positioned by said plate opening in step (b) upon axial movement of said tool, said tool extending beyond the axial position of said plate opening prior to engagement of said working tool with the free end of said tube, and;

(e) working the free end of said tube with said tool centered relative to said tube axis.

2. The method of claim 1 wherein the difference between the outer diameter of said tool extension and the expanded diameter of said tube bore is less than 0.004 inch.

3. The method of claim 1 wherein step (c) occurs near the end of the operation of step (b).

4. The method of claim 3 wherein said working tool is an extruder tool having a diameter larger than the nominal diameter of said bore and axial engagement of said tool with said free end of said tube upsets said tube end to form a braze cup.

5. The method of claim 4 further including the step of removing said tool and inserting a fluid conduit in said braze cup.

6. The method of claim 4 incorporating a pair of said tubes positioned within a pair of spaced openings in said plate and further including the step of inserting a return bend having ends spaced apart a distance equal to the spacing of said openings into the braze cups formed on said tube ends.

7. The method of claim 6 wherein step (c) occurs near the end of the operation of step (b).

8. A method of working in situ the ends of at least a pair of spaced apart hollow tubes of a heat exchanger positioned within a heat exchanger core, each of said tubes having a bore and central axis, said method comprising the steps of:

(a) positioning said hollow tubes through a pair of spaced openings in a plate forming a part of said core with a free end of each of said tubes extending beyond said plate, (b) expanding said tubes by forcing a pair of expansion rods having enlarged heads through said pair of tubes to radially expand said tubes into frictional abutment with said plate openings to accurately locate said tubes relative to said plate openings, (c) axially moving a pair of working tools positioned about said pair of rods toward said free ends of said tubes, (d) centering said working tools relative to said plate openings by means of axial tool extensions, one on each of said tools, entering said tube bores as positioned by said plate openings in step (b) upon axial movement of said tools, and (e) further expanding the free ends of said tubes with said tools centered relative to said plate openings to form a pair of braze cups, and (f) inserting the free ends of a return bend spaced equally to the spacing between said plate openings into said pair of braze cups.

9. The method of claim 8 wherein said tool extensions extend beyond the axial positions of said plate openings prior to engagement of said tools with the free end of said tubes.

10. The method of claim 8 wherein said heat exchanger core has multiple fin plates surrounding said tubes, said fin plates having openings receiving said tubes and wherein said expansion of step (b) creates a good thermal contact relationship between said tubes and said fin plates.

* * * * *